US010443930B2

(12) United States Patent
Jiang

(10) Patent No.: US 10,443,930 B2
(45) Date of Patent: Oct. 15, 2019

(54) PROCESS AND SYSTEM FOR REMOVING NITROGEN FROM LNG

(71) Applicant: Black & Veatch Corporation, Overland Park, KS (US)

(72) Inventor: Hao Jiang, Beijing (CN)

(73) Assignee: Black & Veatch Holding Company, Overland Park, KS (US)

( * ) Notice: Subject to any disclaimer, the term of this patent is extended or adjusted under 35 U.S.C. 154(b) by 0 days.

(21) Appl. No.: 14/320,149

(22) Filed: Jun. 30, 2014

(65) Prior Publication Data

US 2015/0377551 A1 Dec. 31, 2015

(51) Int. Cl.
*F25J 3/02* (2006.01)

(52) U.S. Cl.
CPC ..... *F25J 3/0257* (2013.01); *F25J 3/0209* (2013.01); *F25J 3/0233* (2013.01); *F25J 2200/02* (2013.01); *F25J 2200/74* (2013.01); *F25J 2215/04* (2013.01); *F25J 2270/12* (2013.01); *F25J 2270/66* (2013.01); *F25J 2290/34* (2013.01)

(58) Field of Classification Search
CPC ..... F25J 3/0233; F25J 3/0257; F25J 2200/02; F25J 2200/74
USPC ..... 62/623
See application file for complete search history.

(56) References Cited

U.S. PATENT DOCUMENTS 3,596,472 A * 8/1971 Streich ..... F25J 1/0022 62/623
3,763,658 A 10/1973 Gaumer, Jr. et al.
4,004,430 A 1/1977 Solomon et al.
4,033,735 A * 7/1977 Swenson ..... F25J 1/0022 62/612
5,133,793 A 7/1992 Billy
5,505,049 A 4/1996 Coyle et al.
5,657,643 A 8/1997 Price
5,669,234 A 9/1997 Houser et al.
6,016,665 A 1/2000 Cole et al.
6,119,479 A 9/2000 Roberts et al.
6,289,692 B1 9/2001 Houser et al.
6,308,531 B1 10/2001 Roberts et al.
8,328,995 B2 12/2012 Eddington
(Continued)

FOREIGN PATENT DOCUMENTS

AU 657816 5/1993
AU 2005216022 9/2005
(Continued)

OTHER PUBLICATIONS

The International Search Report and Written Opinion dated Aug. 24, 2015, in the PCT/US2015/037126 filed Jun. 23, 2015.
(Continued)

*Primary Examiner* — Tareq Alosh
(74) *Attorney, Agent, or Firm* — Hovey Williams LLP

(57) ABSTRACT

Processes and systems are provided for removing nitrogen from a hydrocarbon-containing gas to thereby recover a liquid natural gas (LNG) stream. In particular, the processes and systems described herein can be used to efficiently separate methane from nitrogen, which is an undesirable byproduct found in many hydrocarbon-containing gases used to produce LNG. The processes and systems described herein can utilize various refrigerant systems to separate and produce the LNG.

29 Claims, 1 Drawing Sheet

(56) References Cited

U.S. PATENT DOCUMENTS

| | | | | |
|---|---|---|---|---|
| 2009/0205367 | A1* | 8/2009 | Price | F25J 3/0223 62/612 |
| 2009/0277217 | A1 | 11/2009 | Ransbarger et al. | |
| 2011/0048067 | A1* | 3/2011 | Fischer | F25J 1/0022 62/620 |
| 2011/0226008 | A1 | 9/2011 | Gushanas et al. | |
| 2011/0239701 | A1 | 10/2011 | Kaart et al. | |
| 2011/0289963 | A1 | 12/2011 | Price | |
| 2012/0137726 | A1 | 6/2012 | Currence et al. | |
| 2012/0285196 | A1 | 11/2012 | Flinn et al. | |
| 2013/0205828 | A1* | 8/2013 | Sethna | F25J 1/0022 62/607 |
| 2013/0213087 | A1 | 8/2013 | Currence | |

FOREIGN PATENT DOCUMENTS

| | | |
|---|---|---|
| CA | 2741970 | 6/2010 |
| CA | 2842122 | 6/2013 |
| CN | 1946979 | 4/2007 |
| CN | 102115684 | 7/2011 |
| CN | 102435044 | 5/2012 |
| CN | 102713479 | 10/2013 |
| EA | 200601542 | 9/2005 |
| EP | 1715267 | 10/2006 |
| KZ | 16497 | 11/2005 |
| RU | 2085815 | 5/1993 |
| RU | 2502026 | 11/2009 |
| SU | 315374 | 9/1971 |
| WO | 2013055305 | 4/2013 |

OTHER PUBLICATIONS

Google Translation of SU312374 retrieved Feb. 19, 2019.
Chinese Office Action dated Dec. 5, 2018.
Translation of Chinese Office Action dated Dec. 5, 2018.
Gulf Cooperation Council Office Action dated Jun. 30, 2018.
Colombian Office Action dated Jul. 25, 2018.
Translation of Colombian Office Action dated Jul. 25, 2018.
Kazakhstan Office Action dated Mar. 12, 2018.
Translation of Kazakhstan Office Action dated Mar. 12, 2018.
Russian Office Action dated Dec. 17, 2018.
Translation of Russian Office Action dated Dec. 17, 2018.
Russian Search Report dated Dec. 17, 2018.
Translation of Russian Search Report dated Dec. 17, 2018.

* cited by examiner

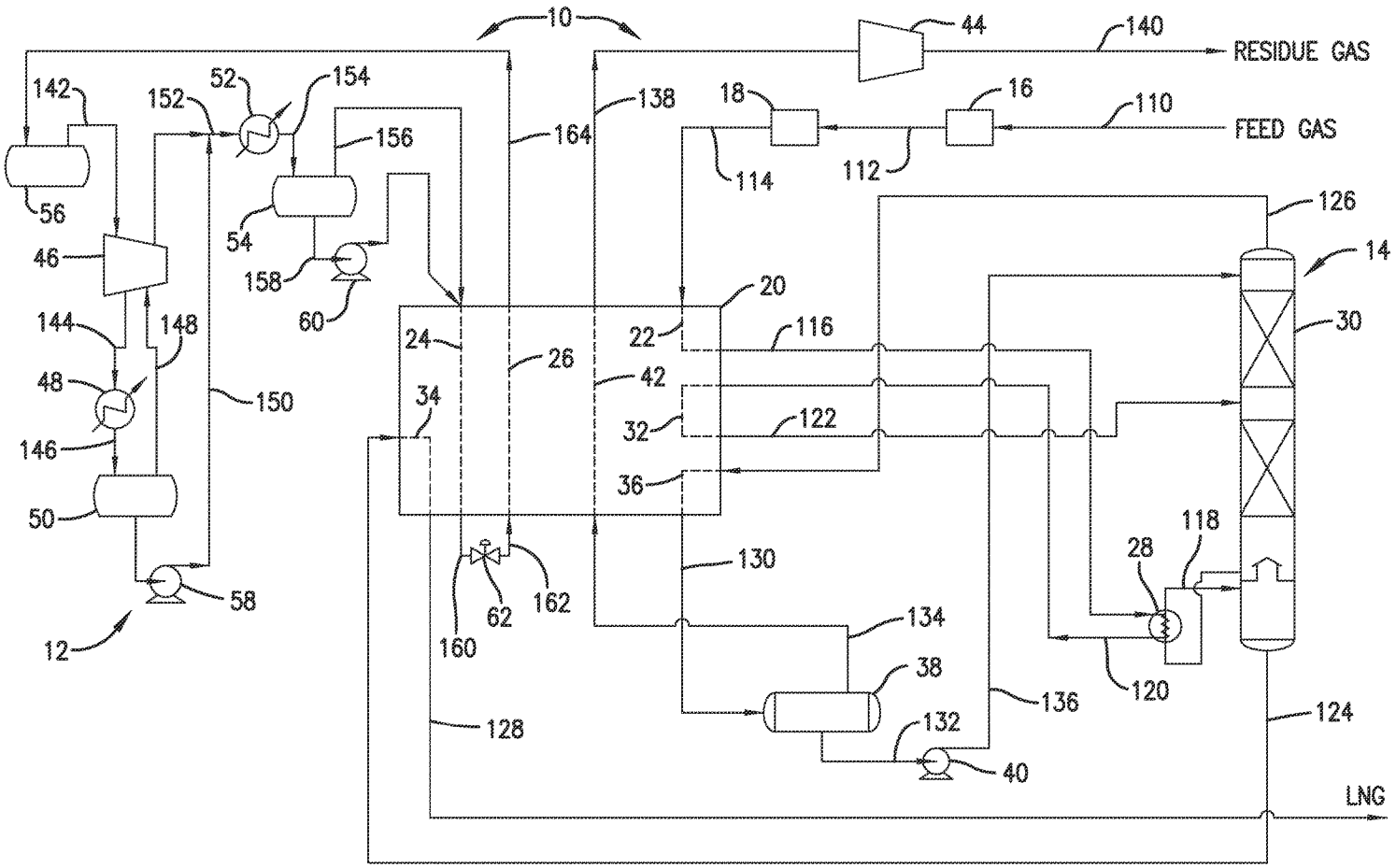
RESIDUE GAS
FEED GAS
LNG
10
12
14
16
18
20
22
24
26
28
30
32
34
36
38
40
42
44
46
48
50
52
54
56
58
60
62
110
112
114
116
118
120
122
124
126
128
130
132
134
136
138
140
142
144
146
148
150
152
154
156
158
160
162
164

PROCESS AND SYSTEM FOR REMOVING NITROGEN FROM LNG

BACKGROUND

1. Field of the Invention

The present invention is generally related to processes and systems for recovering a liquid natural gas ("LNG") from a hydrocarbon-containing gas. More particularly, the present invention is generally related to processes and systems for removing nitrogen from a hydrocarbon-containing gas and producing a LNG stream.

2. Description of the Related Art

Due to the increased demand for methane, unconventional gas sources have been increasingly utilized as feed streams to produce LNG. However, such unconventional gas sources can contain high concentrations of nitrogen, which can cause several operational problems as the gases are subjected to liquefaction in a LNG facility. For example, the presence of high concentrations of nitrogen in the gas feed streams can prevent the methane from fully condensing and can negatively affect the quality of the produced LNG stream.

Due to the commercial value of methane, it can be desirable in some cases to remove at least a portion of the nitrogen from the gas feed streams during processing. However, some conventional processes for removing nitrogen can only be commercially viable for certain types of feed streams depending on their nitrogen concentration. Furthermore, many of the conventional nitrogen removal processes are not particularly suited for removing smaller concentrations of nitrogen from gas feed streams during processing. Moreover, it can be difficult to regulate temperature and other operating conditions during many of these conventional nitrogen removal processes, which can negatively impact the ability to effectively remove nitrogen from the resulting LNG stream and to produce a specification LNG product.

Therefore, there is a need for processes and systems that can more effectively remove lower concentrations of nitrogen from hydrocarbon-containing gases when producing LNG.

SUMMARY

One or more embodiments described herein concern a process for recovering methane from a hydrocarbon-containing gas. The process comprises: (a) cooling and at least partially condensing a feed stream comprising the hydrocarbon-containing gas to thereby provide a cooled feed stream, wherein the hydrocarbon-containing gas comprises in the range of 0.5 to 30 mole percent of nitrogen; (b) fractionating at least a portion of the cooled feed stream in a distillation column to thereby form a nitrogen-poor bottom stream and a nitrogen-rich overhead stream, wherein the fractionating occurs at a pressure in the range of 1 to 8 MPa and the nitrogen-rich overhead stream comprises at least 75 percent of the nitrogen originally present in the hydrocarbon-containing gas; and (c) recovering at least a portion of the nitrogen-poor bottom stream to thereby form an LNG-enriched stream.

One or more embodiments described herein concern a process for recovering methane from a hydrocarbon-containing gas. The process comprises: (a) cooling and at least partially condensing a feed stream comprising the hydrocarbon-containing gas to thereby provide a cooled feed stream, wherein the hydrocarbon-containing gas comprises in the range of 0.5 to 30 mole percent of nitrogen; (b) fractionating at least a portion of the cooled feed stream in a distillation column to thereby form a nitrogen-poor bottom stream and a nitrogen-rich overhead stream, wherein the nitrogen-rich overhead stream comprises at least 75 percent of the nitrogen originally present in the hydrocarbon-containing gas; (c) cooling at least a portion of the nitrogen-rich overhead stream to thereby form a cooled nitrogen-rich overhead stream; (d) separating the cooled nitrogen-rich overhead stream into a liquid reflux stream and a vapor byproduct; (e) introducing at least a portion of the liquid reflux stream into the distillation column; and (f) cooling at least a portion of the nitrogen-poor bottom stream to thereby form an LNG-enriched stream.

One or more embodiments described herein concern a facility for recovering methane from a hydrocarbon-containing gas. The facility comprises: (a) a primary heat exchanger having a first cooling pass disposed therein, wherein the first cooling pass is configured to cool the hydrocarbon-containing gas into a cooled hydrocarbon-containing gas; (b) a distillation column in fluid communication with the first cooling pass, wherein the distillation column comprises a first inlet to receive the cooled hydrocarbon-containing gas, wherein the distillation column is configured to separate the cooled hydrocarbon-containing gas into a nitrogen-rich overhead stream and a nitrogen-poor bottom stream; (c) a second cooling pass disposed within the primary heat exchanger in fluid communication with the distillation column, wherein the second cooling pass is configured to cool the nitrogen-poor bottom stream into an LNG-enriched liquid stream; (d) a third cooling pass disposed within the primary heat exchanger in fluid communication with the distillation column, wherein the third cooling pass is configured to cool the nitrogen-rich overhead stream into a cooled nitrogen-rich stream; (e) a reflux system in fluid communication between the third cooling pass and the distillation column, wherein the reflux system is configured to separate the cooled nitrogen-rich stream into a liquid reflux stream and a vapor byproduct; and (f) a single closed-loop mixed refrigeration cycle at least partially disposed within the primary heat exchanger.

BRIEF DESCRIPTION OF THE FIGURES

Embodiments of the present invention are described herein with reference to the following drawing FIGURES, wherein:

FIG. 1 provides a schematic depiction of a LNG recovery facility configured according to one embodiment of the present invention, particularly illustrating the use of a single closed-loop mixed refrigerant system to recover methane from a feed gas stream.

DETAILED DESCRIPTION

The following detailed description of embodiments of the invention references the accompanying drawing. The embodiments are intended to describe various aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

The present invention is generally directed to processes and systems for removing nitrogen from a hydrocarbon-containing gas and recovering an LNG stream comprising methane. As described below, these processes and systems can utilize a refrigerant system to assist in the removal of nitrogen and recovery of methane from the hydrocarbon-containing gases. Although FIG. 1 depicts this refrigerant system as comprising a single closed-loop mixed refrigeration cycle, one skilled in the art would appreciate that another refrigeration system can be used in the process and system described below. For example, the refrigeration system can comprise a single mixed refrigerant stream in a closed-loop refrigeration cycle, a dual mixed refrigerant cycle, or a cascade refrigeration cycle. Such refrigeration systems are described in U.S. Pat. Nos. 3,763,658, 5,669,234, 6,016,665, 6,119,479, 6,289,692, and 6,308,531, the disclosures of which are incorporated herein by reference in their entireties.

Turning now to FIG. 1, a schematic depiction of a LNG recovery facility 10 configured according to one or more embodiments of the present invention is provided. The LNG recovery facility 10 can be operable to remove or recover a substantial portion of the total amount of methane in the incoming hydrocarbon-containing gas stream by cooling the gas with a single closed-loop refrigeration cycle 12 and separating the resulting condensed liquids in a LNG separation zone 14. Additional details regarding the configuration and operation of LNG recovery facility 10, according to various embodiments of the present invention, are described below in reference to FIG. 1.

As shown in FIG. 1, a hydrocarbon-containing gas feed stream can initially be introduced into the LNG recovery facility 10 via conduit 110. The hydrocarbon-containing gas can be any suitable hydrocarbon-containing fluid stream, such as, for example, a natural gas stream, a syngas stream, a cracked gas stream, associated gas from oil production, or combinations thereof. The hydrocarbon-containing gas stream in conduit 110 can originate from a variety of gas sources (not shown), including, but not limited to, a natural gas pipeline distribution network; a petroleum production well; a refinery processing unit, such as a fluidized catalytic cracker (FCC) or petroleum coker; or a heavy oil processing unit, such as an oil sands upgrader. In certain embodiments, the hydrocarbon-containing gas in conduit 110 can comprise or consist of a syngas.

Depending on its source, the hydrocarbon-containing gas can comprise varying amounts of methane, nitrogen, hydrogen, carbon monoxide, and other hydrocarbons. For example, the hydrocarbon-containing gas can comprise at least 1, 5, 10, 15, or 25 and/or not more than 90, 80, 70, 60, 50, or 40 mole percent of methane. More particularly, the hydrocarbon-containing gas can comprise in the range of 1 to 90, 5 to 70, 10 to 60, 15 to 50, or 25 to 40 mole percent of methane. It should be noted that all mole percentages are based on the total moles of the hydrocarbon-containing gas.

Furthermore, in various embodiments, the hydrocarbon-containing gas can comprise at least 0.5, 1, 2, 3, or 5 and/or not more than 40, 35, 30, 20, or 15 mole percent of nitrogen. More particularly, the hydrocarbon-containing gas can comprise in the range of 0.5 to 40, 1 to 35, 2 to 30, 3 to 20, or 5 to 15 mole percent of nitrogen. In certain embodiments, the hydrocarbon-containing gas comprises lower concentrations of nitrogen in order to better facilitate the nitrogen removal process described below.

Additionally or alternatively, the hydrocarbon-containing gas can comprise at least 25, 40, or 50 and/or not more than 99, 90, or 75 mole percent of hydrogen. More particularly, the hydrocarbon-containing gas can comprise in the range of 25 to 99, 40 to 90, or 50 to 70 mole percent of hydrogen. In certain embodiments, the hydrocarbon-containing gas comprises little to no hydrogen. For example, the hydrocarbon-containing gas can comprise less than 10, 5, 1, or 0.5 mole percent of hydrogen.

In various embodiments, the hydrocarbon-containing gas can comprise little to no carbon monoxide. For example, the hydrocarbon-containing gas can comprise not more than 20, 10, 5, or 1 mole percent of carbon monoxide.

Furthermore, the hydrocarbon-containing gas can comprise some amount of $C_2$-$C_5$ components, which includes paraffinic and olefinic isomers thereof. For example, the hydrocarbon-containing gas can comprise less than 15, 10, 5, or 2 mole percent of $C_2$-$C_5$ components.

As shown in FIG. 1, the hydrocarbon-containing gas in conduit 110 may initially be routed to a pretreatment zone 16, wherein one or more undesirable constituents may be removed from the gas prior to cooling. In one or more embodiments, the pretreatment zone 16 can include one or more vapor-liquid separation vessels (not shown) for removing liquid water or hydrocarbon components from the feed gas. Optionally, the pretreatment zone 16 can include one or more gas removal zones (not shown), such as, for example, an amine unit or molecular sieve, for removing carbon dioxide or sulfur-containing compounds from the gas stream in conduit 110.

The treated gas stream exiting pretreatment zone 16 via conduit 112 can then be routed to a dehydration unit 18, wherein substantially all of the residual water can be removed from the feed gas stream. Dehydration unit 18 can utilize any known water removal system, such as, for example, beds of molecular sieve. Once dried, the gas stream in conduit 114 can have a temperature of at least 5, 10, or 15° C. and/or not more than 100, 75, or 40° C. More particularly, the gas stream in conduit 114 can have a temperature in the range of 5 to 100° C., 10 to 75° C., or 15 to 40° C. Additionally or alternatively, the gas stream in conduit 114 can have a pressure of at least 1.5, 2.5, 3.5, or 4 and/or not more than 9, 8, 7.5, or 7 MPa. More particularly, the gas stream in conduit 114 can have a pressure in the range of 1.5 to 9, 2.5 to 8, 3.5 to 7.5, or 4 to 7 MPa.

As shown in FIG. 1, the hydrocarbon-containing feed stream in conduit 114 can be introduced into a first cooling pass 22 of a primary heat exchanger 20. The primary heat exchanger 20 can be any heat exchanger or series of heat exchangers operable to cool and at least partially condense the feed gas stream in conduit 114 via indirect heat exchange with one or more cooling streams. In one or more embodiments, the primary heat exchanger 20 can be a brazed aluminum heat exchanger comprising a single cooling and warming pass (e.g., core) or a plurality of cooling and warming passes (e.g., cores) disposed therein for facilitating indirect heat exchange between one or more process streams and one or more refrigerant streams. Although generally illustrated in FIG. 1 as comprising a single core or "shell," it should be understood that primary heat exchanger 20 can, in some embodiments, comprise two or more separate core or shells, optionally encompassed by a "cold box" to minimize heat gain from the surrounding environment.

The hydrocarbon-containing feed gas stream passing through the cooling pass 22 of primary heat exchanger 20 can be cooled and at least partially condensed via indirect heat exchange with refrigerant and/or residue gas streams in respective passes 26 and 42, which are described below in further detail. During cooling, a substantial portion of the methane components in the feed gas stream can be condensed out of the vapor phase to thereby provide a cooled, two-phase gas stream in conduit 116. In one or more embodiments, at least 10, 25, 50, 60, 70, 80, or 90 percent of the total amount of methane introduced into primary exchanger 20 via conduit 114 can be condensed within cooling pass 22.

The cooled gas stream in conduit 116 can have a temperature of −5, −10, −20, or −30° C. and/or not colder than −200, −150, −100, or −75° C. More particularly, the cooled gas stream in conduit 116 can have a temperature in the range of −5 to −200° C., −10 to −150° C., −20 to −100° C., or −30 to −75° C. In certain embodiments, the cooled gas stream in conduit 116 can have a temperature of about −33° C. Additionally or alternatively, the cooled gas stream in conduit 116 can have a pressure of at least 1.5, 2.5, 3.5, or 4 and/or not more than 9, 8, 7.5, or 7 MPa. More particularly, the gas stream in conduit 116 can have a pressure in the range of 1.5 to 9, 2.5 to 8, 3.5 to 7.5, or 4 to 7 MPa.

As shown in FIG. 1, the cooled gas stream in conduit 116 can be transferred to at least one reboiler 28 to optionally function as heat media for the distillation column 30. The reboiler 28 can be used to heat and at least partially vaporize a liquid stream withdrawn from the distillation column 30 via conduit 118. The reboiler 28 can heat the liquid stream from conduit 118 via indirect heat exchange with a warming fluid stream, such as, for example, the cooled gas stream in conduit 116. Although generally illustrated as including a single reboiler 28, it should be understood that any suitable number of reboilers, operable to withdraw streams at the same or different mass transfer stages within distillation column 30, can be employed in order to maintain the desired temperature and/or composition profile therein.

While in the reboiler 28, the cooled gas stream from conduit 116 can be further cooled by the liquid stream from conduit 118. For example, while in the reboiler 28, the temperature of the cooled gas stream from conduit 116 can be lowered by at least 10, 20, 30, 40, or 50° C. and/or not more than 100, 80, 70, or 60° C. More particularly, while in the reboiler 28, the temperature of the cooled gas stream from conduit 116 can be lowered in the range of 20 to 100° C., 30 to 80° C., 40 to 70° C., or 50 to 60° C.

Upon exiting the reboiler 28, the cooled gas stream in conduit 120 can have a temperature of at least −30, −50, −65, or −80 and/or not colder than −200, −175, −150, or −100° C. More particularly, the cooled gas stream in conduit 120 can have a temperature in the range of −30 to −200° C., −50 to −175° C., −65 to −150° C., or −80 to −100° C.

Furthermore, in various embodiments, the cooled gas stream in conduit 120 can have a pressure of at least 1.5, 2.5, 3.5, or 4.5 and/or not more than 9, 8, 7, or 6 MPa. More particularly, the gas stream in conduit 120 can have a pressure in the range of 1.5 to 9, 2.5 to 8, 3.5 to 7, or 4.5 to 6 MPa. It should be noted that the only pressure drop at this point in the system can be generally attributed to inefficiencies associated with the piping, heat exchanger, and other processing units.

Turning again to FIG. 1, at least a portion of the cooled gas stream in conduit 120 can be routed to a cooling pass 32 disposed within the primary heat exchanger 20, wherein the gas stream can be cooled and at least partially condensed via indirect heat exchange with the refrigerant and/or residue gas streams in respective passes 26 and 42. During cooling, a substantial portion of the methane components in the cooled gas stream from conduit 120 can be condensed out of the vapor phase to thereby provide a further cooled, two-phase gas stream in conduit 122. In one or more embodiments, at least 50, 60, 70, 80, or 90 percent of the total amount of methane introduced into primary exchanger 20 via conduit 120 that is in vapor form can be condensed within cooling pass 32.

The cooled gas stream in conduit 122 can have a temperature of at least −30, −50, −80, or −100 and/or not colder than −200, −175, −150, or −120° C. More particularly, the cooled gas stream in conduit 122 can have a temperature in the range of −30 to −200° C., −50 to −175° C., −80 to −150° C., or −100 to −120° C. In certain embodiments, the cooled gas stream in conduit 122 can have a temperature of about −110° C. Additionally or alternatively, the cooled gas stream in conduit 122 can have a pressure of at least 1.5, 2.5, 3.5, or 4.5 and/or not more than 9, 8, 7, or 6 MPa. More particularly, the gas stream in conduit 122 can have a pressure in the range of 1.5 to 9, 2.5 to 8, 3.5 to 7, or 4.5 to 6 MPa.

As shown in FIG. 1, the cooled, preferably two-phase stream in conduit 122 can be introduced into the distillation column 30 and subjected to fractionation. The distillation column 30 can be any vapor-liquid separation vessel capable of further separating methane from hydrogen, carbon monoxide, and nitrogen. In one or more embodiments, the distillation column 30 can be a multi-stage distillation column comprising at least 2, 5, 10, or 12 and/or not more than 50, 40, 30, or 20 actual or theoretical separation stages. When the distillation column 30 comprises a multi-stage column, one or more types of column internals may be utilized in order to facilitate heat and/or mass transfer between the vapor and liquid phases. Examples of suitable column internals can include, but are not limited to, vapor-liquid contacting trays, structured packing, random packing, and any combination thereof.

In various embodiments, the distillation column 30 can be operable to separate at least 65, 75, 85, 90, or 99 percent of the methane present in the fluid streams introduced thereto. The distillation column 30 can operate at a pressure of at least 1, 1.5, 2, or 2.4 and/or not more than 7, 6, 5, or 4.2 MPa. More particularly, the distillation column 30 can operate at a pressure in the range of 1 to 7, 1.5 to 6, 2 to 5, or 2.4 to 4.2 MPa. In certain embodiments, the distillation column 30 can operate at a pressure of about 2.6 MPa or at a pressure of about 4.2 MPa depending on the nitrogen content of the hydrocarbon-containing gas used as the feed stream.

The temperature of the distillation column 30 can vary depending on the contents of the hydrocarbon-containing gas introduced into the system. In various embodiments, the top half of the distillation column 30 can operate at a temperature of at least −75, −100, −120, or −155° C. and/or not colder than −215, −200, −190, or −180° C. More particularly, the top half of the distillation column 30 can operate at a temperature in the range of −75 to −215° C., −100 to −200° C., −120 to −190° C., or −155 to −180° C. Furthermore, the bottom half of the distillation column 30 can operate at a temperature of at least −35, −50, −65, or −85° C. and/or not colder than −200, −175, −150, or −110° C. More particularly, the bottom half of the distillation column 30 can operate at a temperature in the range of −35 to −200° C., −50 to −175° C., −65 to −150° C., or −85 to −110° C.

As depicted in FIG. 1, a nitrogen-poor bottom stream exits the distillation column 30 via conduit 124 and a nitrogen-rich overhead stream exits the distillation column 30 via conduit 126.

As used herein, "nitrogen-poor" and "nitrogen-rich" refer to the nitrogen content of the separated components relative to the nitrogen content of the original component from which the separated components are derived. Thus, a nitrogen-rich component contains a greater mole percentage of nitrogen than the component from which it is derived, while a nitrogen-poor component contains a lesser mole percentage of nitrogen than the component from which it is derived. In the present case, the nitrogen-rich overhead stream contains a higher mole percentage of nitrogen compared to the stream from conduit 122, while nitrogen-poor bottom stream contains a lower mole percentage of nitrogen compared to the stream from conduit 122. The amounts of the nitrogen-rich overhead stream and the nitrogen-poor bottom stream can vary depending on the contents of the hydrocarbon-containing gas in conduit 110 and the operating conditions of the distillation column 30.

The nitrogen-poor bottom stream in conduit 124 can be in the form of a liquid and comprise a significant amount of methane. For example, the nitrogen-poor bottom stream in conduit 124 can comprise at least 60, 75, 80, 85, 90, 95, 96, or 97.5 mole percent of methane. Additionally or alternatively, the nitrogen-poor bottom stream in conduit 124 can comprise not more than 99.9, 99, or 98 mole percent of methane.

Due to the fractionating in the distillation column 30, the nitrogen-poor bottom stream in conduit 124 can contain residual amounts of nitrogen. For example, the nitrogen-poor bottom stream in conduit 124 can contain at least 50, 60, 70, 80, 85, 90, or 95 percent less nitrogen than the hydrocarbon-containing gas based on mole percentage of nitrogen. In various embodiments, the nitrogen-poor bottom stream in conduit 124 can comprise less than 10, 8, 6, 5, 4, 3, 2, or 1 mole percent of nitrogen.

The nitrogen-poor bottom stream in conduit 124 can also comprise some residual hydrogen and carbon monoxide. For example, the nitrogen-poor bottom stream in conduit 124 can comprise less than 1, 0.5, 0.1, or 0.01 mole percent of hydrogen. Additionally or alternatively, the nitrogen-poor bottom stream in conduit 124 can comprise less than 1, 0.5, 0.1, or 0.01 mole percent of carbon monoxide. In certain embodiments, the nitrogen-poor bottom stream in conduit 124 comprises substantially no hydrogen and/or carbon monoxide.

Furthermore, in various embodiments, the nitrogen-poor bottom stream in conduit 124 can comprise at least 0.5, 1, 1.5, or 2 and/or not more than 20, 10, 8, 6, or 4 mole percent of $C_2$-$C_6$ hydrocarbons. More particularly, the nitrogen-poor bottom stream in conduit 124 can comprise in the range of 0.5 to 20, 1 to 10, 1.5 to 6, or 2 to 4 mole percent of $C_2$-$C_6$ hydrocarbons.

As shown in FIG. 1, the nitrogen-poor bottom stream in conduit 124 can be routed to a cooling pass 34 disposed within the primary heat exchanger 20, wherein the liquid stream can be cooled and at least partially condensed via indirect heat exchange with the refrigerant and/or residue gas streams in respective passes 26 and 42. The cooled stream exiting cooling pass 34 via conduit 128 can be an LNG-enriched product. As used herein, "LNG-enriched" means that the particular composition comprises at least 50 mole percent of methane. It should be noted that this LNG-enriched product generally has the same composition as the nitrogen-poor bottom stream in conduit 124 described above. Thus, all the composition properties and ranges discussed above in regard to the nitrogen-poor bottom stream in conduit 124 can also apply to the LNG-enriched product in conduit 128. The LNG-enriched product in conduit 128 can have a temperature of at least −120, −130, −140, or −145° C. and/or not colder than −200, −190, −180, or −165° C. More particularly, the LNG-enriched product in conduit 128 can have a temperature in the range of −120 to −200° C., −130 to −190° C., −140 to −180° C., or −145 to −165° C. In certain embodiments, the LNG-enriched product in conduit 128 can have a temperature of about −156° C.

Turning back to the nitrogen-rich overhead stream in conduit 126, this stream can be in the form of a vapor and can contain most of the nitrogen originally found in the hydrocarbon-containing gas in conduit 110. For example, the nitrogen-rich overhead stream in conduit 126 can comprise at least 60, 75, 80, 85, 90, 95, or 98 percent of the nitrogen originally present in the hydrocarbon-containing gas. In various embodiments, the nitrogen-rich overhead stream in conduit 126 can comprise at least 5, 10, 25, 50, 75, 80, 85, 90, or 95 mole percent of nitrogen.

Furthermore, the nitrogen-rich overhead stream in conduit 126 can comprise most of the hydrogen and/or carbon monoxide originally found in the hydrocarbon-containing gas. For example, the nitrogen-rich overhead stream in conduit 126 can comprise at least 40, 55, 75, 85, or 99 percent of the hydrogen and/or carbon monoxide originally present in the hydrocarbon-containing gas.

In various embodiments, the nitrogen-rich overhead stream in conduit 126 can comprise at least 5, 15, 25, or 30 and/or not more than 75, 65, 50, or 40 mole percent of hydrogen. Alternatively, the nitrogen-rich overhead stream in conduit 126 can comprise substantially no hydrogen. For example, the nitrogen-rich overhead stream in conduit 126 can comprise less than 25, 15, 10, 5, or 1 mole percent of hydrogen. Additionally or alternatively, the nitrogen-rich overhead stream in conduit 126 can comprise less than 25, 15, 10, 5, or 1 mole percent of carbon monoxide.

Moreover the nitrogen-rich overhead stream in conduit 126 can comprise some residual methane. For instance, the nitrogen-rich overhead stream in conduit 126 can comprise less than 10, 5, 4, 3, 2, or 1 mole percent of methane.

As shown in FIG. 1, the nitrogen-rich overhead stream in conduit 126 can be routed to a cooling pass 36 disposed within the primary heat exchanger 20, wherein the stream can be cooled and at least partially condensed via indirect heat exchange with the refrigerant and/or residue gas streams in respective passes 26 and 42. The cooled gas stream exiting cooling pass 36 via conduit 130 can have a temperature of at least −120, −130, −140, or −145° C. and/or not colder than −200, −190, −180, or −165° C. More particularly, the cooled stream in conduit 130 can have a temperature in the range of −120 to −200° C., −130 to −190° C., −140 to −180° C., or −145 to −165° C. In certain embodiments, the cooled stream in conduit 130 can have a temperature of about −156° C.

The cooled stream in conduit 130 can then be routed to a reflux condenser drum 38, wherein at least a portion of the cooled stream in conduit 130 can be divided into a nitrogen-poor liquid reflux stream and an overhead nitrogen-rich stream. The nitrogen-poor liquid reflux stream exits the reflux condenser drum 38 via conduit 132 and the overhead nitrogen-rich stream exits the reflux condenser drum 38 via conduit 134.

The reflux condenser drum 38 can separate the cooled stream in conduit 130 at a pressure of at least 1, 1.5, 2, or 2.4 and/or not more than 8, 6, 5, or 4.2 MPa. More particularly, the reflux condenser drum 38 can operate at a pressure in the range of 1 to 8, 1.5 to 6, 2 to 5, or 2.4 to 4.2 MPa. In certain embodiments, the pressure in the reflux condenser drum 38 can be the same as or substantially same as the pressure in the distillation column 30. As used herein, "substantially same as" means that the pressure varies by less than 5 percent.

The nitrogen-poor liquid reflux stream in conduit 132 can comprise most of the methane originally present in the cooled stream in conduit 130. For example, the nitrogen-poor liquid reflux stream in conduit 132 can comprise at least 50, 65, 75, or 95 percent of the methane originally present in the cooled stream in conduit 130. In various embodiments, the nitrogen-poor liquid reflux stream in conduit 132 can comprise at least 10, 25, 40, or 65 and/or not more than 99, 95, 85, or 80 mole percent of methane. More particularly, the nitrogen-poor liquid reflux stream in conduit 132 can comprise in the range of 10 to 99, 25 to 95, 40 to 85, or 65 to 80 mole percent of methane.

Additionally or alternatively, the nitrogen-poor liquid reflux stream in conduit 132 can comprise residual amounts of nitrogen. For example, the nitrogen-poor liquid reflux stream in conduit 132 can comprise less than 40, 25, 15, 5, or 2 mole percent of nitrogen.

Furthermore, in certain embodiments, nitrogen-poor liquid reflux stream in conduit 132 can comprise hydrogen if present in the original hydrocarbon-containing gas. For example, the nitrogen-poor liquid reflux stream in conduit 132 can comprise at least 0.1, 0.5, 1, or 3 and/or not more than 20, 15, 10, or 5 mole percent of hydrogen. More particularly, the nitrogen-poor liquid reflux stream in conduit 132 can comprise in the range of 0.1 to 20, 0.5 to 15, 1 to 10, or 3 to 5 mole percent of hydrogen. In certain embodiments, the nitrogen-poor liquid reflux stream in conduit 132 can comprise substantially no hydrogen.

At least a portion of the nitrogen-poor liquid reflux stream in conduit 132 can be pumped via reflux pump 40 to conduit 136 where it can be transferred to distillation column 30 to be used as a reflux stream. The use of the nitrogen-poor liquid reflux stream in conduit 132 as a reflux stream can help minimize methane losses in the facility 10. Furthermore, the use of the nitrogen-poor liquid reflux stream in conduit 132 as a reflux stream can allow greater control over temperature conditions in the distillation column 30, which can increase the efficiency of separating nitrogen and methane in the distillation column 30.

Turning again to FIG. 1, the overhead nitrogen-rich stream in conduit 134 can comprise most of the nitrogen originally present in the cooled stream in conduit 130. For example, the overhead nitrogen-rich stream in conduit 134 can comprise at least 50, 65, 75, or 95 percent of the nitrogen originally present in the cooled stream in conduit 130. In various embodiments, the overhead nitrogen-rich stream in conduit 134 can comprise at least 10, 25, 50, 65, 80, or 95 mole percent of nitrogen.

Furthermore, the overhead nitrogen-rich stream in conduit 134 can comprise residual amounts of methane. For example, the overhead nitrogen-rich stream in conduit 134 can comprise less than 10, 6, 5, 3, 2, or 1 mole percent of methane.

Additionally or alternatively, the overhead nitrogen-rich stream in conduit 134 can comprise hydrogen if present in the hydrocarbon-containing gas. For example, the overhead nitrogen-rich stream in conduit 134 can comprise at least 15, 25, 35, or 50 and/or not more than 99, 95, 85, or 80 mole percent of hydrogen. More particularly, the overhead nitrogen-rich stream in conduit 134 can comprise in the range of 15 to 99, 25 to 95, 35 to 85, or 50 to 80 mole percent of hydrogen. In certain embodiments, the overhead nitrogen-rich stream in conduit 134 can comprise substantially no hydrogen.

As shown in FIG. 1, the overhead nitrogen-rich stream in conduit 134 can be routed to a warming pass 42 of the primary heat exchanger 20, wherein the stream can be warmed via indirect heat exchange with passes 22, 24, 32, 34, and 36. The resulting warmed vapor stream in conduit 138 can optionally be compressed via residue gas compressor 44 before being routed out of the LNG recovery facility 10 via conduit 140. Once removed from LNG recovery facility 10, the compressed gas stream in conduit 140 can be routed to further use, processing, and/or storage.

Turning now to refrigeration cycle 12 of the LNG recovery facility 10 depicted in FIG. 1, this refrigeration cycle is further described in U.S. Pat. No. 5,657,643, which is incorporated by reference in its entirety. The closed-loop refrigeration cycle 12 is illustrated as generally comprising a refrigerant compressor 46, an optional interstage cooler 48 and interstage accumulator 50, a refrigerant condenser 52, a refrigerant accumulator 54, and a refrigerant suction drum 56. As shown in FIG. 1, a mixed refrigerant stream withdrawn from suction drum 56 via conduit 142 can be routed to a suction inlet of refrigerant compressor 46, wherein the pressure of the refrigerant stream can be increased. When refrigerant compressor 46 comprises a multistage compressor having two or more compression stages, as shown in FIG. 1, a partially compressed refrigerant stream exiting the first (low pressure) stage of compressor 46 can be routed via conduit 144 to interstage cooler 48, wherein the stream can be cooled and at least partially condensed via indirect heat exchange with a cooling medium (e.g., cooling water or air).

The resulting two-phase stream in conduit 146 can be introduced into interstage accumulator 50, wherein the vapor and liquid portions can be separated. A vapor stream withdrawn from accumulator 50 via conduit 148 can be routed to the inlet of the second (high pressure) stage of refrigerant compressor 46, wherein the stream can be further compressed. The resulting compressed refrigerant vapor stream can be recombined with a portion of the liquid phase refrigerant withdrawn from interstage accumulator 50 via conduit 150 and pumped to pressure via refrigerant pump 58, as shown in FIG. 1.

The combined refrigerant stream in conduit 152 can then be routed to refrigerant condenser 52, wherein the pressurized refrigerant stream can be cooled and at least partially condensed via indirect heat exchange with a cooling medium (e.g., cooling water) before being introduced into refrigerant accumulator 54 via conduit 154. As shown in FIG. 1, the vapor and liquid portions of the two-phase refrigerant stream in conduit 154 can be separated and separately withdrawn from refrigerant accumulator 54 via respective conduits 156 and 158. Optionally, a portion of the liquid stream in conduit 158, pressurized via refrigerant pump 60, can be combined with the vapor stream in conduit 156 just prior to or within a refrigerant cooling pass 24 disposed within primary exchanger 20, as shown in FIG. 1. In one embodiment, recombining a portion of the vapor and liquid portions of the compressed refrigerant in this manner may help ensure proper fluid distribution within refrigerant cooling pass 24.

As the compressed refrigerant stream flows through refrigerant cooling pass 24, the stream is condensed and sub-cooled, such that the temperature of the liquid refrigerant stream withdrawn from primary heat exchanger 20 via conduit 160 is well below the bubble point of the refrigerant mixture. The sub-cooled refrigerant stream in conduit 160 can then be expanded via passage through an expansion device 62 (illustrated herein as Joule-Thompson valve 62, although other types of expansion devices may be used), wherein the pressure of the stream can be reduced, thereby cooling and at least partially vaporizing the refrigerant stream. The cooled, two-phase refrigerant stream in conduit 162 can then be routed through a refrigerant warming pass 26, wherein a substantial portion of the refrigeration generated via the expansion of the refrigerant can be recovered as cooling for one or more process streams, including the refrigerant stream flowing through cooling pass 24, as discussed in detail previously. The warmed refrigerant stream withdrawn from primary heat exchanger 20 via conduit 164 can then be routed to refrigerant suction drum 56 before being compressed and recycled through closed-loop refrigeration cycle 12 as previously discussed.

According to various embodiments, during each step of the above-discussed refrigeration cycle, the temperature of the refrigerant can be maintained such that at least a portion, or a substantial portion, of the methane originally present in the feed gas stream can be condensed in primary exchanger 20. For example, in various embodiments, at least 50, 65, 75, 80, 85, 90, or 95 percent of the total methane originally present in the feed gas stream introduced into primary exchanger 20 can be condensed. In some embodiments, operating refrigeration cycle 12 at warmer temperatures may decrease the formation of one or more undesirable byproducts within the feed gas stream, such as, for example nitrogen oxide gums (e.g., $NO_x$ gums) which can form at temperatures below about −100° C. According to embodiments of the present invention, formation of such byproducts can be minimized or nearly eliminated.

In one embodiment, the refrigerant utilized in the closed-loop refrigeration cycle 12 can be a mixed refrigerant. As used herein, the term "mixed refrigerant" refers to a refrigerant composition comprising two or more constituents. In one embodiment, the mixed refrigerant utilized by refrigeration cycle 12 can comprise two or more constituents selected from the group consisting of methane, ethylene, ethane, propylene, propane, isobutane, n-butane, isopentane, n-pentane, and combinations thereof. In some embodiments, the refrigerant composition can comprise methane, ethane, propane, normal butane, and isopentane and can substantially exclude certain components, including, for example, nitrogen or halogenated hydrocarbons. According to one or more embodiments, the refrigerant composition can have an initial boiling point of at least −80, −85, or −90° C. and/or not more than −50, −55, or −60° C. Various specific refrigerant compositions are contemplated according to embodiments of the present invention. Table 1, below, summarizes broad, intermediate, and narrow ranges for several exemplary refrigerant mixtures.

TABLE 1

Exemplary Mixed Refrigerant Compositions

| Component | Broad Range, mole % | Intermediate Range, mole % | Narrow Range, mole % |
|---|---|---|---|
| methane | 0 to 50 | 5 to 40 | 10 to 30 |
| ethylene | 0 to 50 | 5 to 40 | 10 to 30 |
| ethane | 0 to 50 | 5 to 40 | 10 to 30 |
| propylene | 0 to 50 | 5 to 40 | 5 to 30 |
| propane | 0 to 50 | 5 to 40 | 5 to 30 |
| i-butane | 0 to 10 | 0 to 5 | 0 to 2 |
| n-butane | 0 to 25 | 1 to 20 | 5 to 15 |
| i-pentane | 0 to 30 | 1 to 20 | 2 to 15 |
| n-pentane | 0 to 10 | 0 to 5 | 0 to 2 |

In some embodiments of the present invention, it may be desirable to adjust the composition of the mixed refrigerant to thereby alter its cooling curve and, therefore, its refrigeration potential. Such a modification may be utilized to accommodate, for example, changes in composition and/or flow rate of the feed gas stream introduced into LNG recovery facility 10. In one embodiment, the composition of the mixed refrigerant can be adjusted such that the heating curve of the vaporizing refrigerant more closely matches the cooling curve of the feed gas stream. One method for such curve matching is described in detail in U.S. Pat. No. 4,033,735, the disclosure of which is incorporated herein by reference in its entirety.

Thus, the above described processes and systems can be utilized to remove nitrogen from a hydrocarbon-containing gas, thereby allowing the recovery of an LNG stream.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

DEFINITIONS

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

As used herein, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. Thus, the present invention can include a variety of combinations and/or integrations of the embodiments described herein.

As used herein, the term "about" means that the associated value can vary by 10 percent from its recited value.

NUMERICAL RANGES

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

What is claimed is:

1. A process for recovering methane from a hydrocarbon-containing gas with a refrigerant system, the process comprising:

(a) precooling the hydrocarbon-containing gas to thereby form a precooled hydrocarbon-containing gas stream, wherein at least a portion of the precooling is carried out via indirect heat exchange with a single mixed refrigerant stream in a closed-loop refrigeration cycle within a primary heat exchanger;

(b) introducing the precooled hydrocarbon-containing gas stream into a reboiler in fluid communication with a distillation column to provide warming media for the reboiler and to further cool the precooled hydrocarbon-containing gas stream, thereby forming a feed stream comprising the hydrocarbon-containing gas;

(c) cooling and at least partially condensing the feed stream comprising the hydrocarbon-containing gas via indirect heat exchange with the single mixed refrigerant stream in the closed-loop refrigeration cycle within the primary heat exchanger to thereby provide a cooled feed stream, wherein the hydrocarbon-containing gas comprises in the range of 0.5 to 30 mole percent of nitrogen;

(d) fractionating at least a portion of the cooled feed stream in the distillation column to thereby form a nitrogen-poor bottom stream and a nitrogen-rich overhead stream, wherein the fractionating occurs at a pressure in the range of 1 to 8 MPa, wherein the nitrogen-rich overhead stream comprises at least 75 percent of the nitrogen originally present in the hydrocarbon-containing gas; and (e) cooling at least a portion of the nitrogen-poor bottom stream via indirect heat exchange with the single mixed refrigerant stream in the closed-loop refrigeration cycle within the primary heat exchanger to thereby form an LNG-enriched stream.

2. The process of claim 1, wherein the LNG-enriched stream comprises at least 85 percent less nitrogen than the hydrocarbon-containing gas based on mole percentage of nitrogen.

3. The process of claim 1, wherein the hydrocarbon-containing gas comprises less than 20 mole percent of nitrogen.

4. The process of claim 1, wherein the fractionating of step (d) occurs at a pressure in the range of 2 to 6 MPa.

5. The process of claim 1, wherein the LNG-enriched stream comprises less than 3 mole percent of nitrogen.

6. The process of claim 1, further comprising, prior to the precooling of step (a), pretreating the hydrocarbon-containing gas to form a treated hydrocarbon-containing gas, wherein the treated hydrocarbon-containing gas is the hydrocarbon-containing gas in step (a).

7. A process for recovering methane from a hydrocarbon-containing gas with a refrigerant system, the process comprising:

(a) precooling and at least partially condensing a feed stream comprising the hydrocarbon-containing gas via indirect heat exchange with a single mixed refrigerant stream in a closed-loop refrigeration cycle within a primary heat exchanger to thereby provide a precooled feed stream, wherein the hydrocarbon-containing gas comprises in the range of 0.5 to 30 mole percent of nitrogen;

(b) cooling and at least partially condensing the precooled feed stream via indirect heat exchange with the single mixed refrigerant stream in the closed-loop refrigeration cycle within the primary heat exchanger to thereby provide a cooled feed stream;

(c) fractionating at least a portion of the cooled feed stream in a distillation column to thereby form a nitrogen-poor bottom stream and a nitrogen-rich overhead stream, wherein the nitrogen-rich overhead stream comprises at least 75 percent of the nitrogen originally present in the hydrocarbon-containing gas;

(d) cooling at least a portion of the nitrogen-rich overhead stream via indirect heat exchange with the single mixed refrigerant stream in the closed-loop refrigeration cycle within the primary heat exchanger to thereby form a cooled nitrogen-rich overhead stream;

(e) separating the cooled nitrogen-rich overhead stream into a liquid reflux stream and a vapor byproduct;

(f) introducing at least a portion of the liquid reflux stream into the distillation column; and (g) cooling at least a portion of the nitrogen-poor bottom stream via indirect heat exchange with the single mixed refrigerant stream in the closed-loop refrigeration cycle within the primary heat exchanger to thereby form an LNG-enriched stream.

8. The process of claim 7, wherein the LNG-enriched stream comprises at least 85 percent less nitrogen than the hydrocarbon-containing gas based on mole percentage of nitrogen.

9. The process of claim 7, wherein the fractionating of step (c) occurs at a pressure in the range of 2 to 6 MPa.

10. The process of claim 7, wherein the LNG-enriched stream comprises less than 3 mole percent of nitrogen.

11. The process of claim 7, further comprising, prior to the precooling of step (a), pretreating the hydrocarbon-containing gas to form a treated hydrocarbon-containing gas, wherein the treated hydrocarbon-containing gas is the hydrocarbon-containing gas in step (a).

12. The process of claim 7, further comprising, prior to the cooling of step (b), introducing the hydrocarbon-containing gas into a reboiler in fluid communication with the distillation column to thereby form the feed stream in step (a).

13. A facility for recovering liquid methane gas (LNG) from a hydrocarbon-containing gas, the facility comprising:

a primary heat exchanger having a first cooling pass disposed therein, wherein the first cooling pass is configured to cool the hydrocarbon-containing gas into a cooled hydrocarbon-containing gas;

a distillation column in fluid communication with the first cooling pass, wherein the distillation column comprises a first inlet to receive the cooled hydrocarbon-containing gas, wherein the distillation column is configured to separate the cooled hydrocarbon-containing gas into a nitrogen-rich overhead stream and a nitrogen-poor bottom stream;

a second cooling pass disposed within the primary heat exchanger in fluid communication with the distillation column, wherein the second cooling pass is configured to cool the nitrogen-poor bottom stream into an LNG-enriched liquid stream;

a third cooling pass disposed within the primary heat exchanger in fluid communication with the distillation column, wherein the third cooling pass is configured to cool the nitrogen-rich overhead stream into a cooled nitrogen-rich stream;

a reflux system in fluid communication between the third cooling pass and the distillation column, wherein the reflux system is configured to separate the cooled nitrogen-rich stream into a liquid reflux stream and a vapor byproduct; and a single closed-loop mixed refrigeration cycle at least partially disposed within the primary heat exchanger, wherein the single closed-loop mixed refrigerant cycle comprises a refrigerant warming pass disposed in the primary heat exchanger that provides cooling to the first cooling pass, the second cooling pass, and the third cooling pass.

14. The facility of claim 13, further comprising a reboiler in fluid communication with the first cooling pass, wherein the reboiler is configured to cool the hydrocarbon-containing gas prior to being introduced into the first cooling pass.

15. The facility of claim 14, wherein the reboiler is in fluid communication with the distillation column and is configured to provide heating to the distillation column.

16. The facility of claim 13, wherein the reflux system comprises a condenser drum for separating the cooled nitrogen-rich stream into the liquid reflux stream and the vapor byproduct.

17. The facility of claim 13, wherein the reflux system comprises a reflux pump configured to pump the liquid reflux into the distillation column.

18. The facility of claim 13, wherein the liquid reflux stream is introduced into the distillation column via a second inlet, wherein the second inlet is positioned at a higher point relative to the first inlet.

19. The process of claim 1, wherein the LNG-enriched stream of step (c) has a temperature in the range of −165 to −145° C.

20. The process of claim 7, wherein the LNG-enriched stream of step (c) has a temperature in the range of −165 to −145° C.

21. The process of claim 1, wherein the single mixed refrigerant stream is free of nitrogen.

22. The process of claim 1, wherein the single mixed refrigerant stream comprises at least one of the following:

(a) about 5 mole % to about 30 mole % propylene;

(b) about 5 mole % to about 30 mole % propane;

(c) about 1 mole % to about 15 mole % n-butane; or (d) about 1 mole % to about 15 mole % i-pentane.

23. The process of claim 7, wherein the single mixed refrigerant stream is free of nitrogen.

24. The process of claim 7, wherein the single mixed refrigerant stream comprises at least one of the following:

(a) about 5 mole % to about 30 mole % propylene;

(b) about 5 mole % to about 30 mole % propane;

(c) about 1 mole % to about 15 mole % n-butane; or (d) about 1 mole % to about 15 mole % i-pentane.

25. The facility of claim 13, wherein the single closed-loop mixed refrigeration cycle comprises a mixed refrigerant stream free of nitrogen.

26. The facility of claim 13, wherein the single closed-loop mixed refrigeration cycle comprises a mixed refrigerant stream comprising at least one of the following:

(a) about 5 mole % to about 30 mole % propylene;

(b) about 5 mole % to about 30 mole % propane;

(c) about 1 mole % to about 15 mole % n-butane; or (d) about 1 mole % to about 15 mole % i-pentane.

27. The process of claim 1, wherein the single mixed refrigerant stream comprises isopentane.

28. The process of claim 7, wherein the single mixed refrigerant stream comprises isopentane.

29. The facility of claim 13, wherein the single closed-loop mixed refrigeration cycle comprises a mixed refrigerant stream comprising isopentane.

* * * * *